US006219428B1

(12) United States Patent
Tejeda, Jr.

(10) Patent No.: US 6,219,428 B1
(45) Date of Patent: Apr. 17, 2001

(54) BICYCLE MOUNTED SOUND SYSTEM

(76) Inventor: Alejandro Tejeda, Jr., 903 Turley Ct., San Jose, CA (US) 95116

( * ) Notice: Subject to any disclaimer, the term of this patent is extended or adjusted under 35 U.S.C. 154(b) by 0 days.

(21) Appl. No.: 09/288,138

(22) Filed: Apr. 8, 1999

(51) Int. Cl.[7] ..... H04R 1/02

(52) U.S. Cl. ..... 381/334; 381/389; 280/288.4

(58) Field of Search ..... 381/300, 302, 381/86, 87, 334, 386, 182, 389; 455/346, 350, 351; 280/288.2, 288.4, 834

(56) References Cited

U.S. PATENT DOCUMENTS 5,771,305 * 6/1998 Davis ..... 381/386
5,842,714 * 12/1998 Spector ..... 280/288.4

OTHER PUBLICATIONS

"Bike Jammers" dated Jun. 3, 1999, World Wide Web page, 4 sheets, published by Heartland America, 8085 Century Blvd., Chaska, MN 55346.

* cited by examiner

*Primary Examiner*—Minsun Oh Harvey

(57) ABSTRACT

A bicycle sound system is provided including a tote bag adapted for being removably mounted on a bicycle. Also included is a portable audio unit removably positioned within the tote bag for transmitting audio signals from an output thereof upon the receipt of power. Next provided is a speaker unit adapted for being mounted to the bicycle and connected to the portable audio unit via connector wires for audibly transmitting audio signals upon the receipt thereof in combination with the receipt of power. A rechargeable battery pack is mounted on the bicycle for power purposes. A switch unit is adapted for being mounted on one handle bars of the bicycle adjacent to a handle grip thereof. Such switch unit includes a switch connected between the battery pack and the portable audio unit and the speaker unit via connector wires for providing the portable audio unit and the speaker unit with power upon the depression thereof.

2 Claims, 2 Drawing Sheets

BICYCLE MOUNTED SOUND SYSTEM

BACKGROUND OF THE INVENTION

1. Field of the Invention

The present invention relates to bicycle light systems and more particularly pertains to a new bicycle mounted sound system for listening to music while riding a bicycle.

2. Description of the Prior Art

The use of bicycle light systems is known in the prior art. More specifically, bicycle light systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art include U.S. Pat. No. 4,754,901; U.S. Pat. No. 5,159,712; U.S. Pat. Des. No. 356,301; U.S. Pat. No. 4,445,228; U.S. Pat. No. 3,380,698; and U.S. Pat. No. 2,588,671.

In these respects, the bicycle mounted sound system according to the present invention substantially departs from the conventional concepts and designs of the prior art, and in so doing provides an apparatus primarily developed for the purpose of listening to music while riding a bicycle.

SUMMARY OF THE INVENTION

In view of the foregoing disadvantages inherent in the known types of bicycle light systems now present in the prior art, the present invention provides a new bicycle mounted sound system construction wherein the same can be utilized for listening to music while riding a bicycle.

The general purpose of the present invention, which will be described subsequently in greater detail, is to provide a new bicycle mounted sound system apparatus and method which has many of the advantages of the bicycle light systems mentioned heretofore and many novel features that result in a new bicycle mounted sound system which is not anticipated, rendered obvious, suggested, or even implied by any of the prior art bicycle light systems, either alone or in any combination thereof.

To attain this, the present invention generally comprises a bicycle having a frame with a cross bar and an angled front support bar connected to the cross bar to define a pivot shaft. Such pivot shaft is adapted for receiving a fork that has attached thereto a front wheel of the bicycle. The fork has a pair of handle bars mounted thereon. An angled rear support bar is mounted between the cross bar and the front support bar to define a crank shaft for housing a pedal assembly. A rear fork assembly is connected to the rear support bar to support a rear wheel of the bicycle. The rear fork assembly includes a pair of downwardly extending members and a pair of horizontal members. A rear baggage platform has a pair of stanchions extending upwardly from the rear fork assembly for supporting the platform above the rear wheel. Mounted on a rear edge of the platform of the bicycle is a rear light for illuminating upon the receipt of power. Associated therewith is a front light having a generally cylindrical configuration. The front light is mounted on the handle bars of the bicycle along a longitudinal axis for directing light forwardly therefrom upon the receipt of power. Next provided is a tote bag including a front face, a rear face and a periphery formed therebetween for defining an interior space. The periphery includes a top opening for allowing access to an interior space thereof. The tote bag further includes a pair of laterally spaced straps mounted to the periphery of the tote bag for encompassing the handle bars. Note FIG. 2. As such, the tote bag rests on the cross bar of the bicycle, as shown in FIG. 1. Also included is a portable radio/cassette unit removably positioned within the tote bag. In use, the portable radio/cassette unit is adapted for transmitting audio signals from an output thereof upon the receipt of power. A speaker unit is provided including a casing mounted between the pair of downwardly extending members adjacent to the rear support bar of the bicycle. Ideally, the casing of the speaker unit is positioned along an underside of the downwardly extending members of the bicycle. The speaker unit includes an amplifier and a speaker for audibly transmitting audio signals upon the receipt thereof in combination with the receipt of power. The speaker unit is connected to the radio/cassette unit via connector wires positioned within the crossbar and one of the downwardly extending members of the bicycle. Note FIG. 1. For powering purposes, a rechargeable battery pack is mounted on an underside of the crossbar of the bicycle adjacent to the pivot shaft thereof. FIGS. 2 & 3 best show a switch unit that includes a small rectangular housing having a first face mounted on one of the handle bars of the bicycle. Ideally, the housing is positioned adjacent to a handle grip of the handle bar to which it is attached. A second face of the housing of the switch unit opposite the first face is directed rearwardly. Such second face of the housing of the switch unit includes a first push button toggle switch connected between the battery pack and the lights via connector wires positioned within the crossbar, one of the downwardly extending members, and the platform of the bicycle. In use, the first push button toggle switch serves to provide the lights with power upon the depression thereof. The second face of the housing of the switch unit further includes a second push button toggle switch connected between the battery pack and the portable radio/cassette unit and the speaker unit via connector wires. Similar to the previous connector wires, the present wires are positioned within the crossbar and one of the downwardly extending members of the bicycle. In operation, the second push button toggle switch serves to provide the portable radio/cassette unit and the speaker unit with power upon the depression thereof. Finally, the second face of the housing has a light connected between the second switch and the battery pack. Such light serves for illuminating upon the transmission of power to the portable radio/cassette unit and the speaker unit for indicating the same.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is either intended to define the invention of the application, which is measured by the claims, nor is it intended to be limiting as to the scope of the invention in any way.

It is therefore an object of the present invention to provide a new bicycle mounted sound system apparatus and method which has many of the advantages of the bicycle light systems mentioned heretofore and many novel features that result in a new bicycle mounted sound system which is not anticipated, rendered obvious, suggested, or even implied by any of the prior art bicycle light systems, either alone or in any combination thereof.

It is another object of the present invention to provide a new bicycle mounted sound system which may be easily and efficiently manufactured and marketed.

It is a further object of the present invention to provide a new bicycle mounted sound system which is of a durable and reliable construction.

An even further object of the present invention is to provide a new bicycle mounted sound system which is susceptible of a low cost of manufacture with regard to both materials and labor, and which accordingly is then susceptible of low prices of sale to the consuming public, thereby making such bicycle mounted sound system economically available to the buying public.

Still yet another object of the present invention is to provide a new bicycle mounted sound system which provides in the apparatuses and methods of the prior art some of the advantages thereof, while simultaneously overcoming some of the disadvantages normally associated therewith.

Still another object of the present invention is to provide a new bicycle mounted sound system for listening to music while riding a bicycle.

Even still another object of the present invention is to provide a new bicycle mounted sound system that includes a tote bag adapted for being removably mounted on a bicycle. Also included is a portable audio unit removably positioned within the tote bag for transmitting audio signals from an output thereof upon the receipt of power. Next provided is a speaker unit adapted for being mounted to the bicycle and connected to the portable audio unit via connector wires for audibly transmitting audio signals upon the receipt thereof in combination with the receipt of power. A rechargeable battery pack is mounted on the bicycle for power purposes. A switch unit is adapted for being mounted on one handle bars of the bicycle adjacent to a handle grip thereof. Such switch unit includes a switch connected between the battery pack and the portable audio unit and the speaker unit via connector wires for providing the portable audio unit and the speaker unit with power upon the depression thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
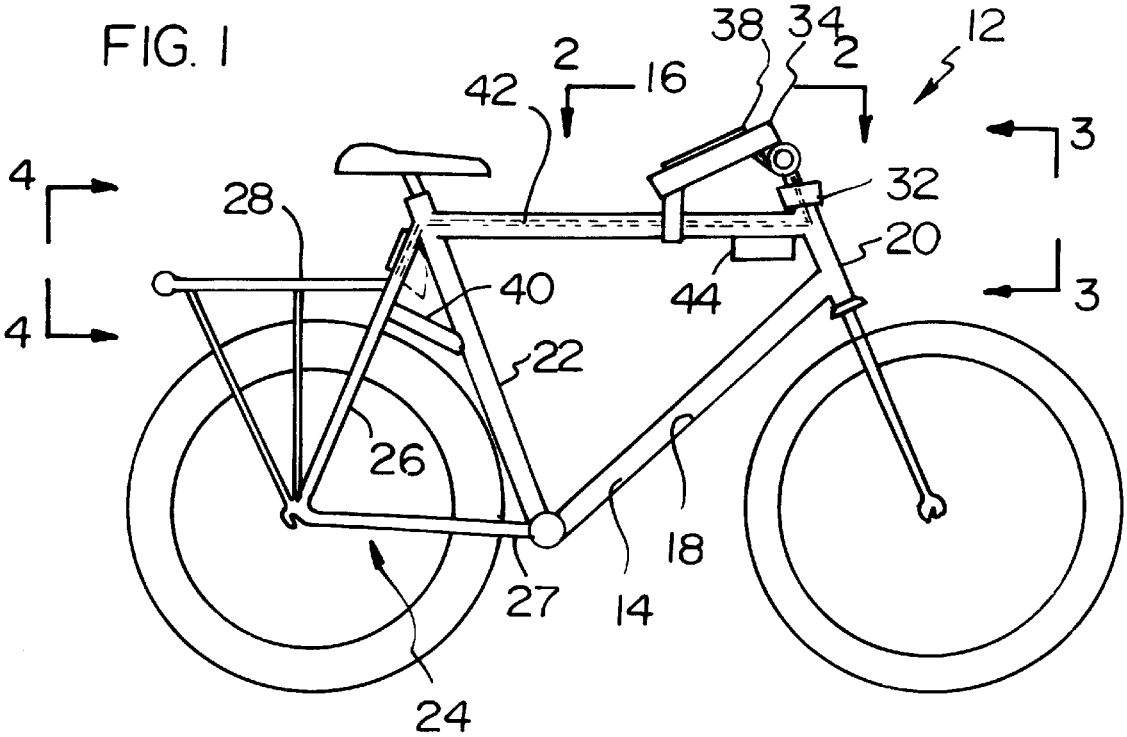
FIG. 1 is a side view of a new bicycle mounted sound system according to the present invention.

With reference now to the drawings, and in particular to FIGS. 1 through 4 thereof, a new bicycle mounted sound system embodying the principles and concepts of the present invention and generally designated by the reference numeral 10 will be described.

The present invention, designated as numeral 10, includes a bicycle 12 having a frame 14 with a cross bar 16 and an angled front support bar 18 connected to the cross bar to define a pivot shaft 20. Such pivot shaft is adapted for receiving a fork that has attached thereto a front wheel of the bicycle. The fork has a pair of handle bars mounted thereon. An angled rear support bar 22 is mounted between the cross bar and the front support bar to define a crank shaft for housing a pedal assembly. A rear fork assembly 24 is connected to the rear support bar to support a rear wheel of the bicycle. The rear fork assembly includes a pair of downwardly extending members 26 and a pair of horizontal members 27. A rear baggage platform 28 has a pair of stanchions extending upwardly from the rear fork assembly for supporting the platform above the rear wheel.

Mounted on a rear edge of the platform of the bicycle is a red rear light 30 for illuminating upon the receipt of power. Associated therewith is a clear front light 32 having a generally cylindrical configuration. The front light is mounted on the handle bars of the bicycle along a longitudinal axis for directing light forwardly therefrom upon the receipt of power.

Next provided is a tote bag 34 including a front face, a rear face and a periphery formed therebetween for defining an interior space. The periphery includes a top opening for allowing access to an interior space thereof. The tote bag further includes a pair of laterally spaced straps 36 mounted to the periphery of the tote bag for encompassing the handle bars. Note FIG. 2. As such, the tote bag rests on the cross bar of the bicycle, as shown in FIG. 1. As an option, the tote bag may be equipped with a zipper for closing the opening and extra space for tape cassettes or the like. Yet a further option includes a connector loop mounted on the rear face of the tote bag about a longitudinal axis for encompassing the cross bar of the bicycle in order to prevent lateral shifting of the tote bag. Note FIG. 1.

Also included is a portable radio/cassette unit 38 removably positioned within the tote bag. In use, the portable radio/cassette unit is adapted for transmitting audio signals from an output thereof upon the receipt of power. The portable radio/cassette unit is preferably equipped with separate controls positioned thereon and is further capable of being used by itself with headphones. In an alternate embodiment, the cassette unit may be excluded in favor of a compact disk player or the like.

A speaker unit 40 is provided including a casing mounted between the pair of downwardly extending members adjacent to the rear support bar of the bicycle. This may be accomplished by brackets, screws, or the like. Ideally, the casing of the speaker unit is positioned along an underside of the downwardly extending members of the bicycle. The speaker unit includes an unillustrated amplifier and a woofer and tweeter speaker for audibly transmitting audio signals upon the receipt thereof in combination with the receipt of power. The speaker unit is connected to the output of the radio/cassette unit via connector wires 42 positioned within the crossbar and one of the downwardly extending members of the bicycle. Note FIG. 1.

For powering purposes, a rechargeable battery pack 44 is mounted on an underside of the crossbar of the bicycle adjacent to the pivot shaft thereof. Ideally, the battery pack is mounted to the frame of the bicycle by way of brackets similar to those associated with the speaker unit. Further, an adapter socket may be positioned on the pack for recharging purposes.

Figure 2:
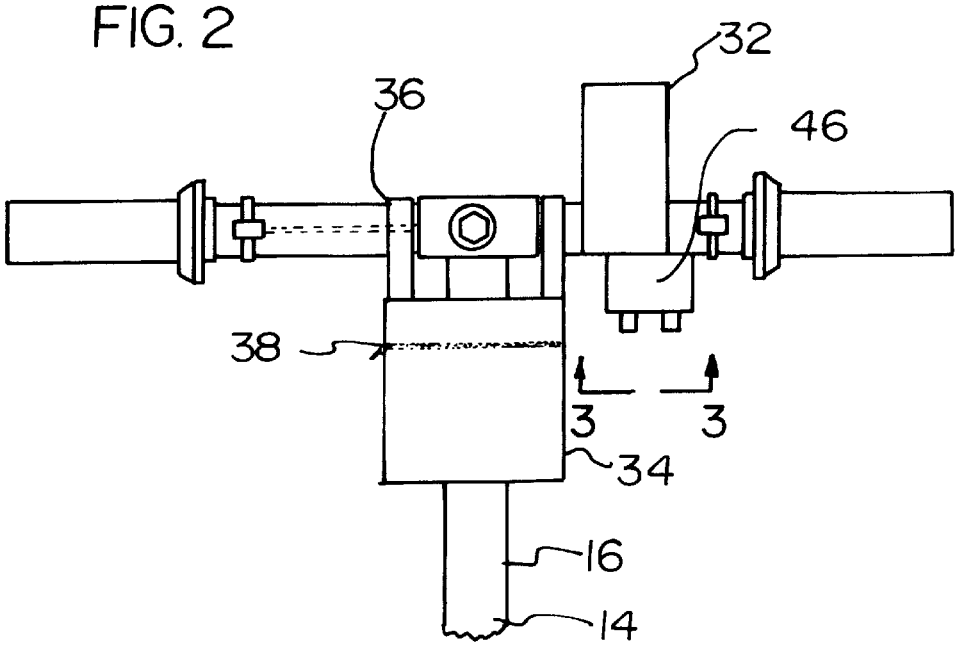
FIG. 2 is a top view of the tote pouch, switch unit and front light of the present invention.
Figure 4:
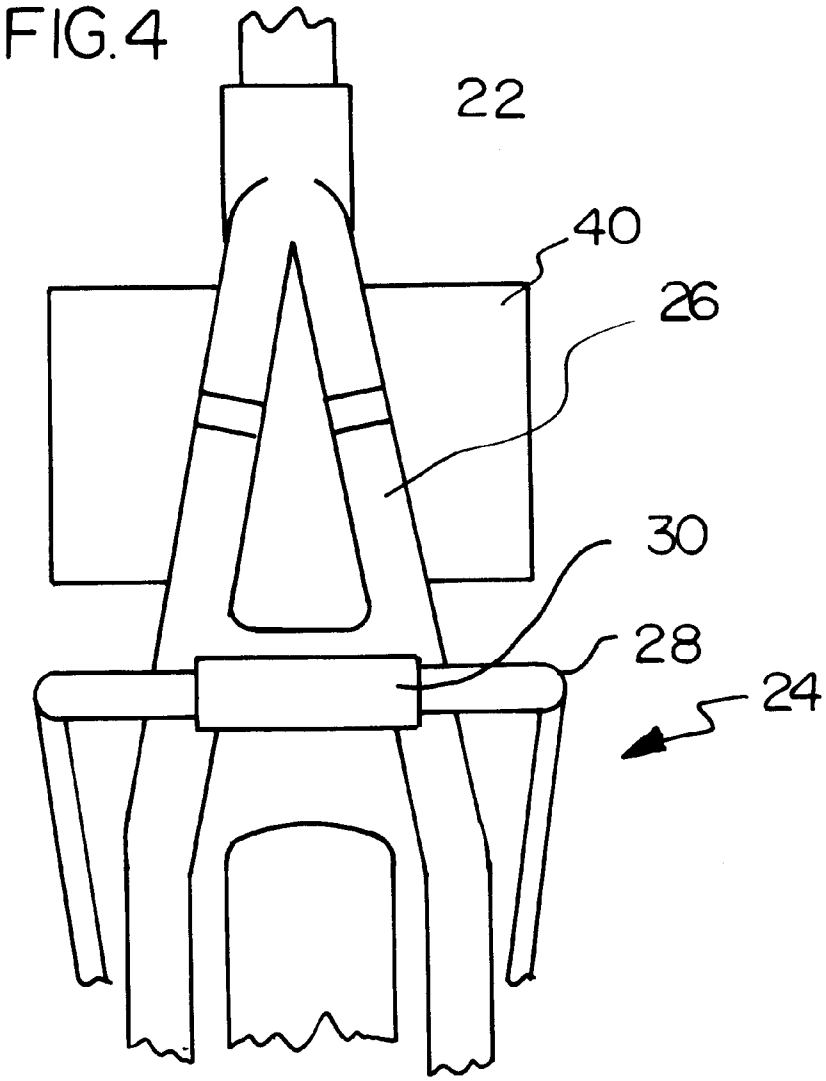
FIG. 4 is a top view of the speaker unit and amplifier of the present invention.
Figure 3:
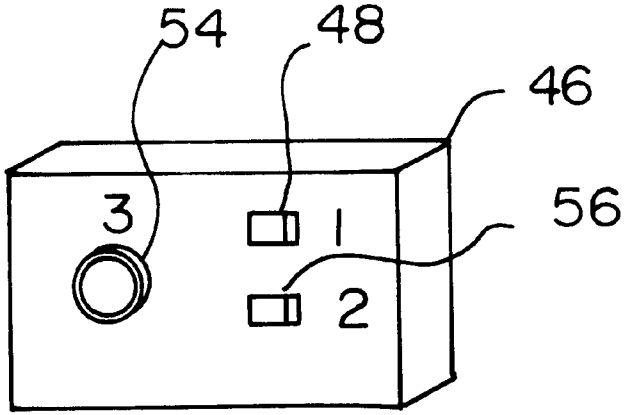
FIG. 3 is a front view of the switch unit of the present invention.

FIGS. 2 & 3 best show a switch unit 46 that includes a small rectangular housing having a first face mounted via a bracket or the like on one of the handle bars of the bicycle. Ideally, the housing is positioned adjacent to a handle grip of the handle bar to which it is attached. Further, the housing preferably has a length of 2 and ⅛ inches, a height of 1 and ⅜ inches, and a thickness of ½ of an inch. A second face of the housing of the switch unit opposite the first face is directed rearwardly. Such second face of the housing of the switch unit includes a first push button toggle 48 switch connected between the battery pack and the lights via connector wires positioned within the crossbar, one of the downwardly extending members, and the platform of the bicycle. In use, the first push button toggle switch serves to provide the lights with power upon the depression thereof.

The second face of the housing of the switch unit further includes a second push button toggle switch 50 connected between the battery pack and the portable radio/cassette unit and the speaker unit via connector wires. Similar to the previous connector wires, the present wires are positioned within the crossbar and one of the downwardly extending members of the bicycle. In operation, the second push button toggle switch serves to provide the portable radio/cassette unit and the speaker unit with power upon the depression thereof.

Finally, the second face of the housing has a light 54 connected between the second switch and the battery pack. Such light serves for illuminating upon the transmission of power to the portable radio/cassette unit and the speaker unit for indicating the same.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bicycle sound system comprising, in combination:

a bicycle including a frame with a cross bar, an angled front support bar connected to the cross bar to define a pivot shaft for a fork that receives a front wheel of the bicycle and a pair of handle bars, an angled rear support bar mounted between the cross bar and the front support bar to define a crank shaft for housing a pedal assembly, a rear fork assembly connected to the rear support bar to support a rear wheel of the bicycle wherein the rear fork assembly includes a pair of downwardly extending members and a pair of horizontal members, and a rear baggage platform having a pair of stanchions extending upwardly from the rear fork assembly for supporting the platform above the rear wheel;

a rear light mounted on a rear edge of the platform of the bicycle for illuminating upon the receipt of power;

a front light having a generally cylindrical configuration mounted on the handle bars of the bicycle for directing light forwardly therefrom upon the receipt of power;

a tote bag including a front face, a rear face and a periphery formed therebetween for defining an interior space, the periphery including a top opening for allowing access to an interior space thereof, the tote bag further including a pair of laterally spaced straps mounted to the periphery of the tote bag for encompassing the handle bars such that the tote bag rests on the cross bar of the bicycle;

a portable radio/cassette unit removably positioned within the tote bag for transmitting audio signals from an output thereof upon the receipt of power;

a speaker unit including a casing mounted between the pair of downwardly extending members adjacent to the rear support bar of the bicycle along an underside of the downwardly extending members of the bicycle, the speaker unit including an amplifier and a speaker for audibly transmitting audio signals upon the receipt thereof in combination with the receipt of power, wherein the speaker unit is connected to the radio/cassette unit via connector wires positioned within the crossbar and one of the downwardly extending members of the bicycle;

a rechargeable battery pack mounted on an underside of the crossbar of the bicycle adjacent to the pivot shaft thereof; and a switch unit including a small rectangular housing having a first face mounted on one of the handle bars of the bicycle adjacent to a handle grip thereof with a second face opposite the first face directed rearwardly, the second face of the housing of the switch unit including a first push button toggle switch connected between the battery pack and the lights via connector wires positioned within the crossbar, one of the downwardly extending members, and the platform of the bicycle, the first push button toggle switch adapted to provide the lights with power upon the depression thereof, the second face of the housing of the switch unit further including a second push button toggle switch connected between the battery pack and the portable radio/cassette unit and the speaker unit via connector wires positioned within the crossbar and one of the downwardly extending members of the bicycle, the second push button toggle switch adapted to provide the portable radio/cassette unit and the speaker unit with power upon the depression thereof, the second face of the housing further including a light connected between the second switch and the battery pack for illuminating upon the transmission of power to the portable radio/cassette unit and the speaker unit for indicating the same.

2. A bicycle sound system for mounting on a bicycle of the type having a frame with a cross bar, a front support bar connected to the cross bar, a pair of handle bars pivotally mounted on the frame, the frame including a rear support bar mounted between the cross bar and the front support bar, a rear fork assembly connected to the rear support bar to support a rear wheel of the bicycle, the rear fork assembly including a pair of downwardly extending members, and a rear baggage platform having a pair of stanchions extending upwardly from the rear fork assembly for supporting the platform above the rear wheel, the system comprising:

a rear light for mounting on a rear edge of the platform of the bicycle for illuminating upon the receipt of power;

a front light for mounting on the handle bars of the bicycle for directing light forwardly from the handle bars upon the receipt of power;

a tote bag including a front face, a rear face and a periphery formed therebetween for defining an interior space, the periphery including a top opening for allowing access to an interior space of the tote bag, the tote bag including at least one strap for mounting the tote bag to the handle bars of the bicycle;

a portable radio/cassette unit removably positionable in the tote bag for transmitting audio signals from an output thereof upon the receipt of power;

a speaker unit including a casing for mounting between the pair of downwardly extending members adjacent to the rear support bar of the bicycle along an underside of the downwardly extending members of the bicycle, the speaker unit including an amplifier and a speaker for audibly transmitting audio signals upon the receipt of audio signals, the speaker unit being connected to the radio/cassette unit;

a rechargeable battery pack for mounting on an underside of the crossbar of the bicycle; and a switch unit including a housing for mounting on the handle bars of the bicycle adjacent, the housing having a face for directing rearwardly on the bicycle, the face of the housing of the switch unit including a first switch connected between the battery pack and the lights the first switch being adapted to provide the lights with power upon the actuation of the first switch, the second face of the housing of the switch unit further including a second switch connected between the battery pack and the portable radio/cassette unit and the speaker unit, the second switch being adapted to provide the portable radio/cassette unit and the speaker unit with power upon the actuation of the second switch, the second face of the housing further including a light connected to the second switch for illuminating upon the supply of power to the portable radio/cassette unit and the speaker unit.

* * * * *